US006641020B1

(12) United States Patent
Yao

(10) Patent No.: US 6,641,020 B1
(45) Date of Patent: Nov. 4, 2003

(54) NAIL BOX DEVICE FOR A NAILING GUN

(75) Inventor: Jerry Yao, Taichung (TW)

(73) Assignee: Bentley Fastening Tools Co., Ltd., Taichung (TW)

( * ) Notice: Subject to any disclaimer, the term of this patent is extended or adjusted under 35 U.S.C. 154(b) by 0 days.

(21) Appl. No.: 10/359,689

(22) Filed: Feb. 7, 2003

(51) Int. Cl.[7] ..... B25C 1/04

(52) U.S. Cl. ..... 227/109; 227/120; 227/123; 227/136

(58) Field of Search ..... 227/109, 119, 227/120, 136, 123

(56) References Cited

U.S. PATENT DOCUMENTS 4,524,896 A * 6/1985 Morrell, Jr. ..... 227/109
4,688,710 A * 8/1987 Massari, Jr. et al. ..... 227/109
4,815,647 A * 3/1989 Chou ..... 227/120
5,522,533 A * 6/1996 Mukoyama et al. ..... 227/136
5,704,532 A * 1/1998 Wey ..... 227/109
5,873,509 A * 2/1999 Liao ..... 227/120

* cited by examiner

*Primary Examiner*—Scott A. Smith
(74) *Attorney, Agent, or Firm*—Troxell Law Office PLLC

(57) ABSTRACT

A nail box device for a nailing gun includes a bottom base and a cover body pivotally combined together, letting the cover body opened and closed easily. The cover body can be locked together with the bottom base when a bolting device is moved upward and closes the nail box. The nail box can be opened when a nail pushing device together with the bolting device is pulled backward to a preset distance, able to open the nail box quickly and load a rowed nail into the nail box precisely.

5 Claims, 7 Drawing Sheets

NAIL BOX DEVICE FOR A NAILING GUN

BACKGROUND OF THE INVENTION

This invention relates to a nail box device for a nailing gun, particularly to one able to make a nail box opened fast for loading a rowed nail into the nail box precisely by moving downward a nail pushing device, convenient in operating.

The nail box of a conventional nailing gun is a hollow shell formed integral and having its upper end fixedly combined with a nail striking guide base. In loading a rowed nail in such a nail box, a nail pushing device has to be pulled backward and fixed at a preset location behind the nail box, and then the rowed nail is loaded in the nail box through its bottom side and resists against the nail striking guide base. Subsequently, release the nail pushing device to let it move forward and push against the bottom side of the rowed nail, letting the rowed nail reach a certain position in the nail striking guide base for use.

However, the conventional nail box is a hollow shell formed integral, therefore when loading a rowed nail in the nail box, an operator has to turn the entire nailing gun upside down in order to view clearly the bottom side of the nail box for precisely loading in the rowed nail, resulting in much trouble and much time wasted in operating.

SUMMARY OF THE INVENTION

This invention has been devised to offer a nail box device for a nailing gun, consisting of a bottom base and a cover body pivotally combined together and provided with a bolting device for locking the nail box and a nail pushing device able to be pulled to make the cover body open automatically for loading a rowed nail into the nail box precisely and quickly.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
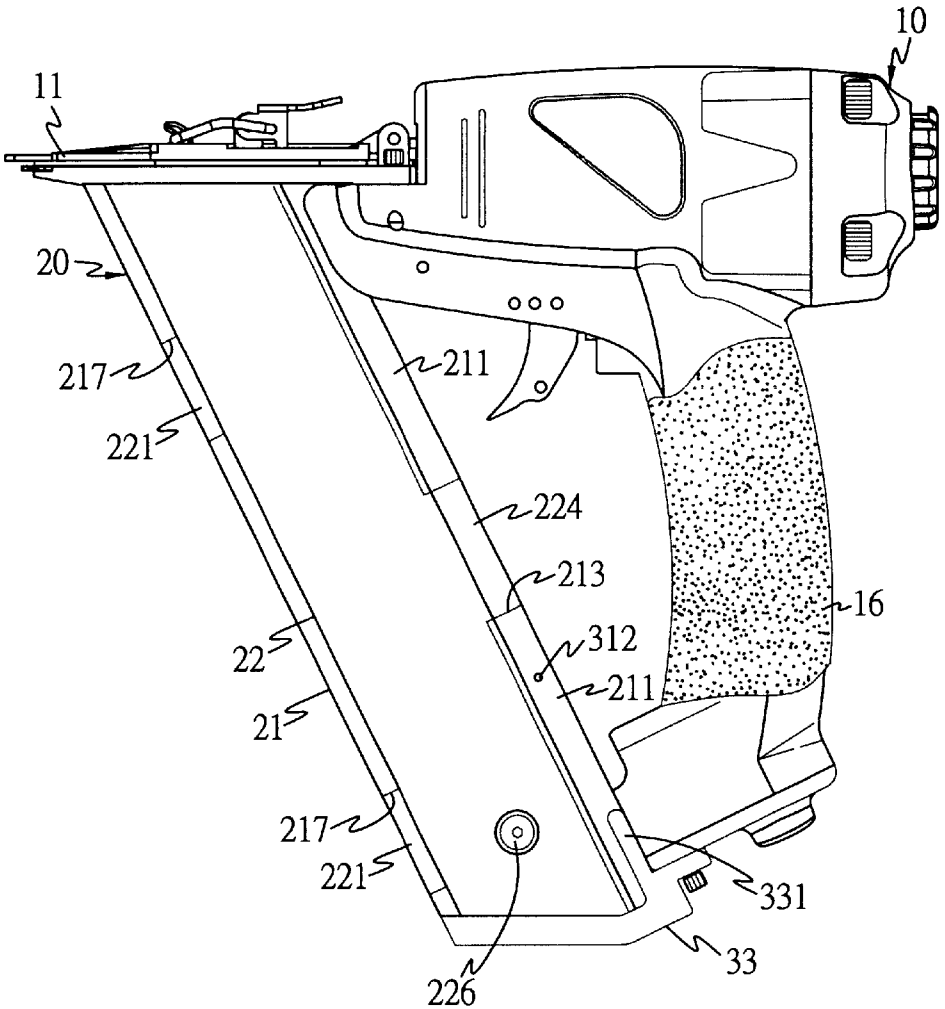
FIG. 1 is a front view of a nailing gun assembled with a nail box in the present invention.
Figure 2:
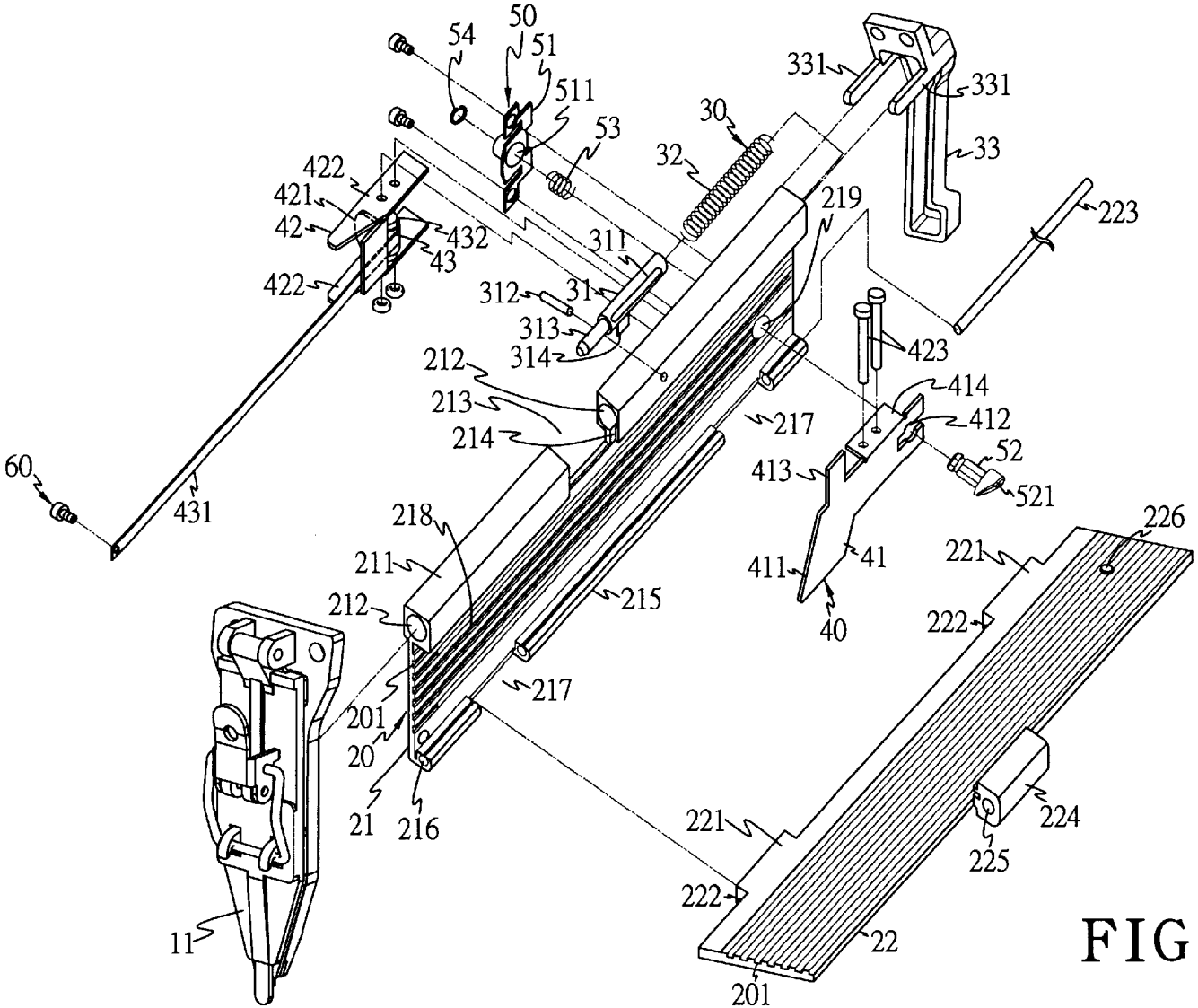
FIG. 2 is an exploded perspective view of the nail box device for the nailing gun in the present invention.
Figure 3:
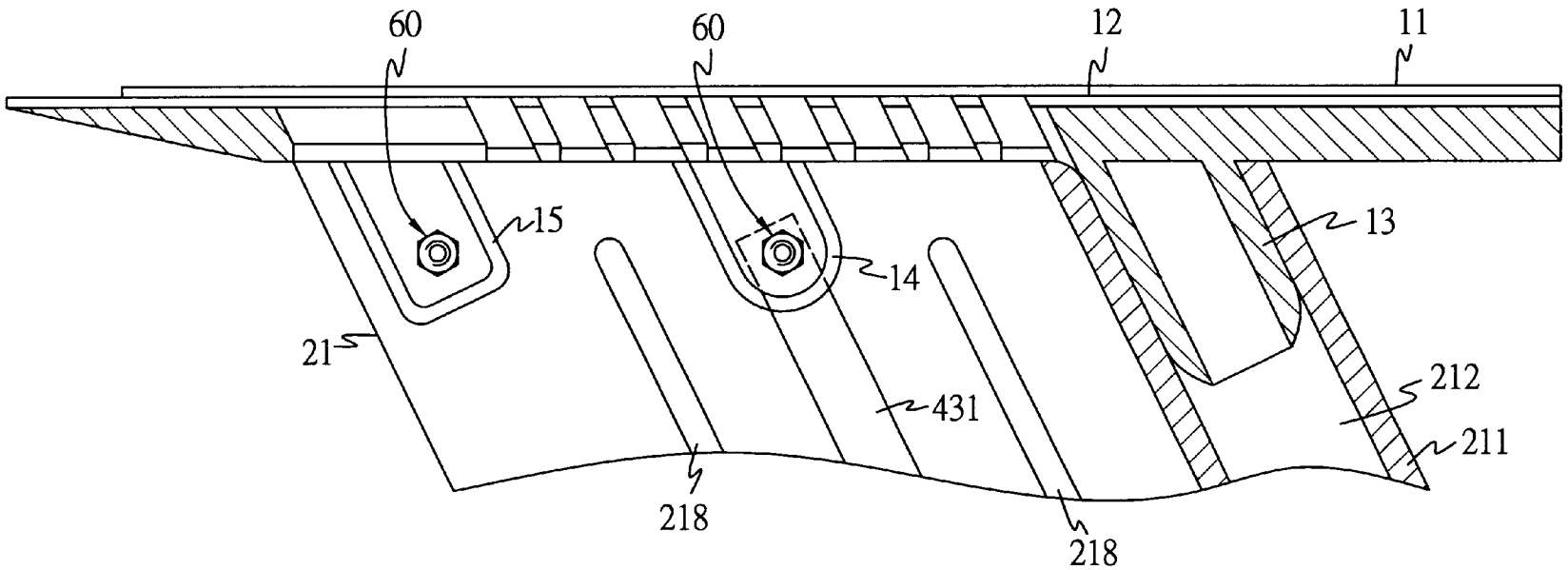
FIG. 3 is a partial cross-sectional view of the nail striking guide base of the nailing gun in the present invention.

A preferred embodiment of a nail box device for a nailing gun in the present invention, as shown in FIGS. 1, 2 and 3, includes a nailing gun 10, a nail box 20, a bolting device 30, a nail pushing device 40 and a blocking device 50 as main components combined together.

The nailing gun 10, as shown in FIG. 3, is provided at the front end with a nail striking guide base 11 having an axial guide groove 12 for a rowed nail to be pushed and fed therethrough. The nail striking guide base 11 further has a combining rod 13 provided at a rear portion to extend downward slantingly, a blocking member 14 also extending downward slantingly and positioned adjacent to the combining rod 13 and a locking member 15 also extending downward slantingly and fixed in front of the blocking member 14.

The nail box 20 consists of a bottom base 21 and a cover body 22 pivotally combined together. The bottom base 21 has one side formed with a fitting tube 211 having an axial shaft hole 212 for receiving the combining rod 13 of the nail striking guide base 11 in an upper section. The bottom base 21 is combined with the locking member 15 of the nail striking guide base 11 by a bolt 60. A fitting opening 213 is formed near the intermediate portion of the fitting tube 211, dividing the fitting tube 211 into two sections. A lengthwise slide groove 214 communicating with the inner side of the bottom base 21 is provided at one side of the shaft hole 212 of the rear section of the fitting tube 211. Besides, the bottom base 21 is formed at the other side with a pivotal tube 215 having an axial pivotal hole 216 and having two pivotal notches 217 respectively formed at its upper and its lower portion. The bottom base 21 further has two lengthwise parallel slide rails 218 fixed between the fitting tube 211 and the pivotal tube 215 and a round hole 219 bored at the rear end between the two slide rails 218.

The cover body 22 has one side formed with two pivotal combining members 221 respectively aligned to the two pivotal notches 217 of the bottom base 21. Each pivotal combining member 221 is axially formed with an axial pivotal hole 222 for receiving a round pivot 223, which is inserted into the pivotal tube 215 of the bottom base 21 for pivotally combining the cover body 22 together with the bottom base 21, enabling the cover body 22 to be pivotally opened and closed on the bottom base 21. A fitting block 224 to be fitted in the fitting opening 213 of the bottom base 21 is fixed on the upper side of the cover body 22, having a locking hole 225. The cover body 22 is further fitted at the rear end with a projecting button 226 matching with the round hole 219 of the bottom base 21. The projecting button 226 is a bolt screwed through the cover body 22 and slightly protruding in its inner side. Furthermore, a plurality of symmetrical and parallel nail guiding grooves 201 is axially formed in the corresponding inner side of the bottom base 21 and the cover body 22 for receiving rowed nails of different specifications.

The bolting device 30 is composed of a bolting rod 31 and a spring 32. The bolting rod 31 is a round rod bored axially with a position-limiting slide groove 311. The bolting device 30 is fitted in the shaft hole 212 of the rear section of the fitting tube 211 of the bottom base 21 positioned therein by a position-limiting bolt 312 inserted laterally through the shaft hole 212 and the position-limiting slide groove 311, permitting the bolting rod 31 slide limitedly in the shaft hole 212. The bolt rod 31 has its upper portion formed with a locking bolt 313 with a comparatively small diameter. The locking bolt 313 slides together with the bolt rod 31 and extends into the locking hole 225 of the fitting block 224 of the cover body 22. The bolt rod 31 is fixed at a lower side with an actuated member 314 to slide along the slide groove 214 of the rear section of the fitting tube 211. The spring 32 is a compression spring having its upper end pushing against the bottom side of the bolt rod 31 and its lower end resisting against a bottom cover 33, which is secured at the bottom of the handle 16 of the nailing gun 10 and has two clamping bars 331 formed symmetrically on one side for clamping firmly the opposite sides of the rear section of thee fitting tube 211 of the bottom base 21, permitting the spring 32 to push the bolt rod 31 upward.

The nail-pushing device 40 is composed of a nail pushing plate 41 and pull plate 42. The nail pushing plate 41 is formed with a push member 411 at the front end for pushing and feeding a rowed nail, an engage slot 412 at the rear end and a pull member 413 beside the push member 411 to act relatively with the actuated member 314 of the bolt rod 31. Besides, the nail pushing plate 41 has two slide members 414 respectively disposed near the opposite sides of the engage slot 412 and extending out of the bottom base 21 for sliding along the two slide rails 218.

The pull plate 42 has a L-shaped pull member 421 provided inside and two fixing members 422 respectively extending outward from the opposite sides to be combined with the two slide members 414 of the nail pushing plate 41 by fixing shafts 423 for moving together. Further, between the two fixing members 422 is pivotally provided a whirled spring 43 having one end of its elastic plate fixed on the blocking member 14 of the nail striking guide base 11, and the other end of its elastic plate wound around a shaft 432, which is pivotally disposed between the two fixing members 422 by means of fixing shafts 423.

The blocking device 50 is composed of a fixing base 51, an engage member 52 and a spring 53. The fixing base 51 is fixedly screwed on the outer side of the round hole 219 of the bottom base 21, having an accommodating slot 511 inside to align concentrically with the round hole 219. The engage member 52 is fitted in the round hole 219, having its lower portion extending out of the accommodating slot 511 and fixed by a clasp 54, and its upper end formed with an engage button 521 to be fitted in the engage slot 412 of the nail pushing plate 41. The spring 53 is received in the accommodating slot 511, having its opposite ends respectively pushing against the accommodating slot 511 and the bottom side of the engage button 521 for pushing elastically the engage button 521 to move upward.

Figure 4:
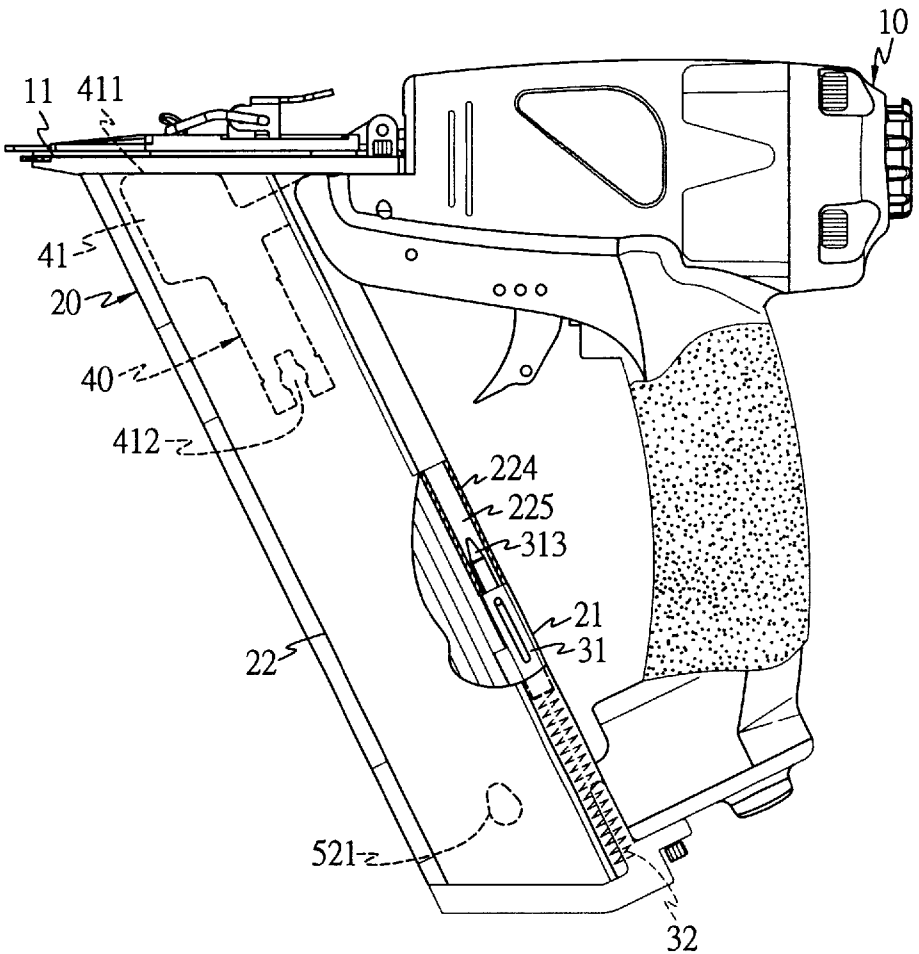
FIG. 4 is a cross-sectional view of the nail box in a closed condition in the present invention.

Specifically, the cover body 22 pivotally combined on the bottom base 21 can be opened and closed, as shown in FIG. 4. When the nail box 20 is in a closed condition, the push member 411 of the nail pushing device 40 will resist against the nail striking base 11, and the locking bolt 313 of the bolt rod 31 will be driven by the spring 32 to extend into the locking hole 225 of the fitting block 224 positioned in the fitting opening 213 of the bottom base 21, thus stabilizing the cover body 22 on the bottom base 21.

Figure 5:
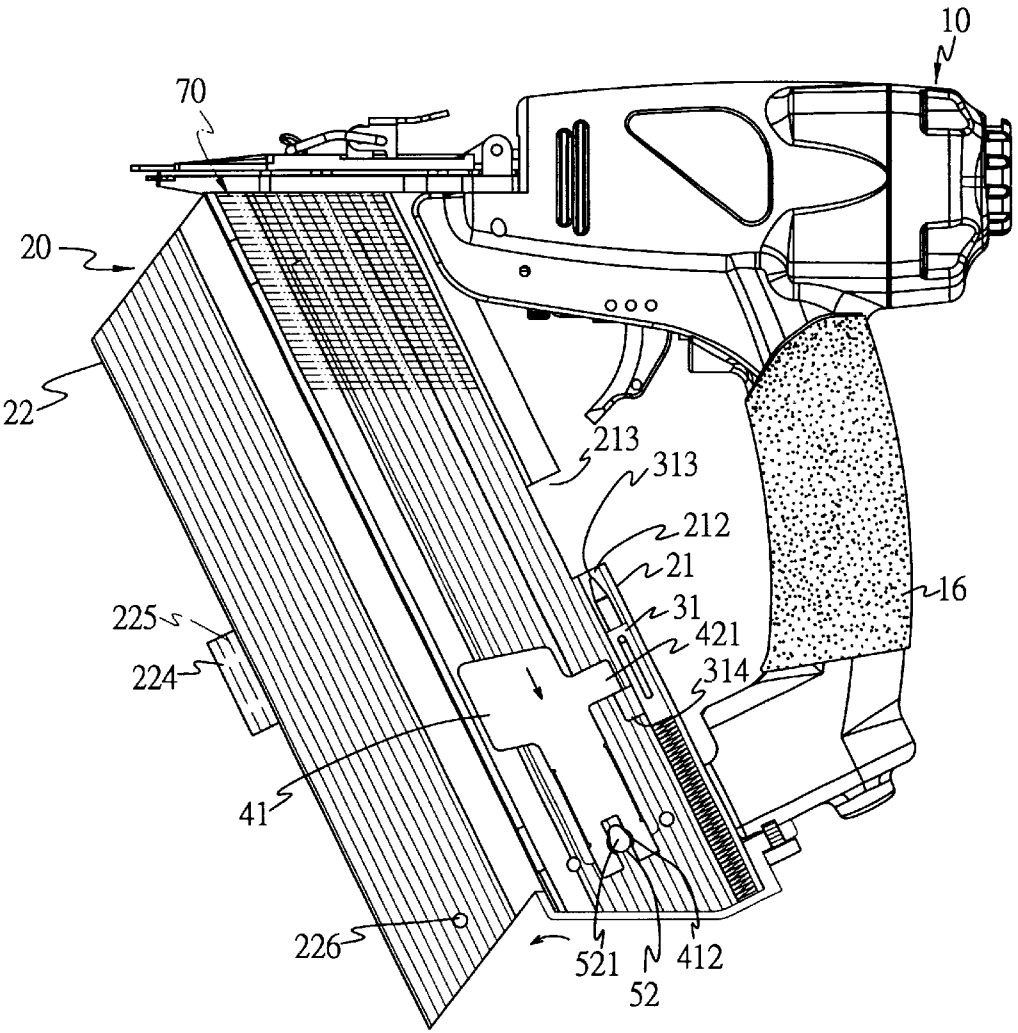
FIG. 5 is a cross-sectional view of the nail box in an open condition in the present invention.
Figure 6:
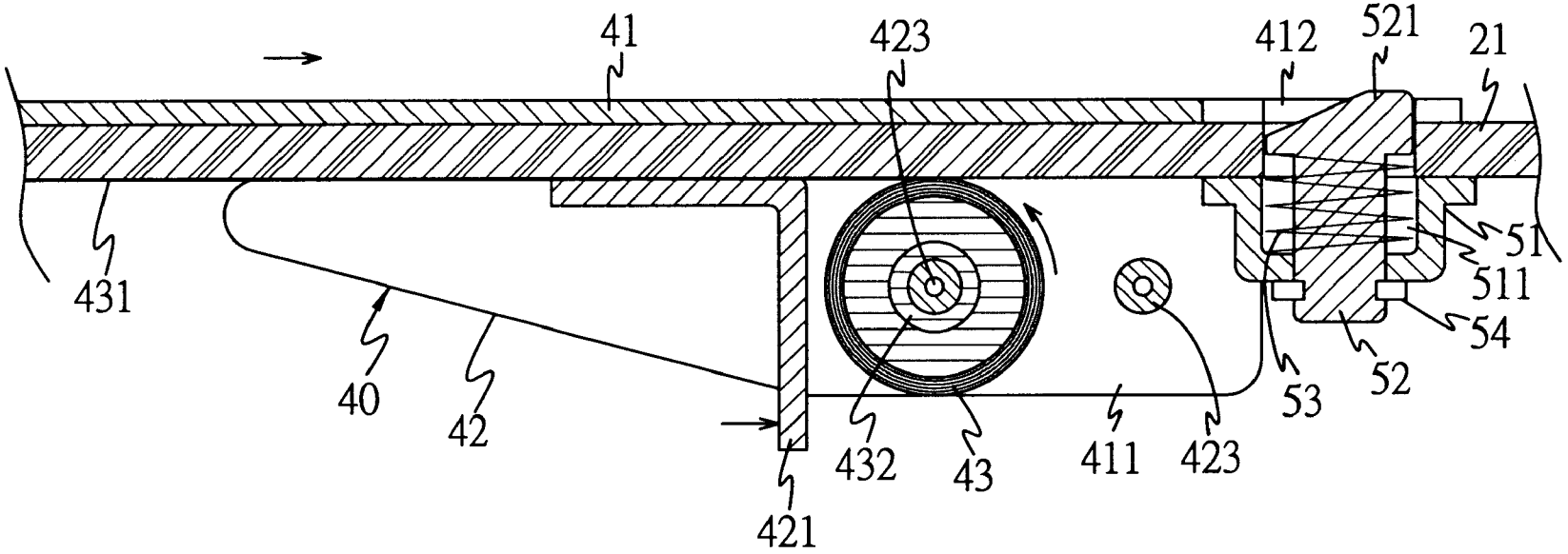
FIG. 6 is a side cross-sectional view of a blocking device engaged with a nail pushing plate in the present invention.
Figure 7:
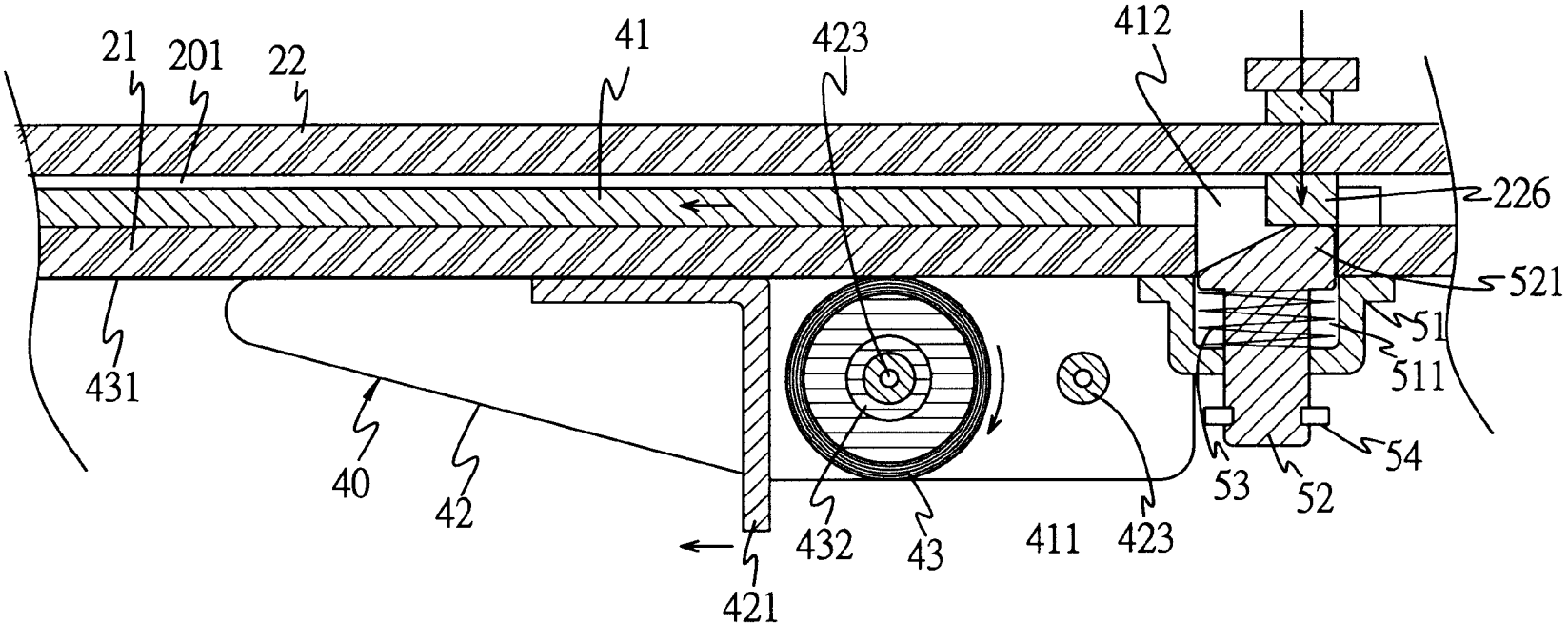
FIG. 7 is a side cross-sectional view of the blocking device disengaged from the nail pushing plate in the present invention.

To open the cover body 22 for loading a rowed nail in the nail box 20, as shown in FIGS. 5 and 6, a user only has to hold the handle 16 of the nailing gun 10 with one hand and pulls downward the pull member 421 of the pull plate 42 of the nail pushing device 40 with the other hand to move the nail pushing plate 41 downward together with its pull member 413. When the pull member 413 moves to the actuated member 314 of the bolt rod 31, it will press the bolt rod 31 to move downward and let its locking bolt 313 disengaged from the locking hole 225 of the fitting block 224 of the cover body 22, letting the cover body 22 opened.

Additionally, when the nail pushing plate 41 is moved downward and its engage slot 412 contacts with the engage member 52 to face the engage button 521, the engage button 521 will automatically and elastically move in the engage slot 412 to fix the nail pushing device in position. When the cover body 22 is opened, as shown in FIG. 5, a rowed nail can be directly loaded in the nail guide groove 24 of the bottom base 21, and after the rowed nail is loaded, the cove body 22 is again closed on the bottom base 21. On the contrary, when the instant the cover body 22 is closed on the bottom base 21, the projecting button 226 positioned on the inner side of the cover body 22 and aligned to the engage member 52 will synchronously press the engage button 521 to move downward and disengage from the engage slot 412 of the nail pushing plate 41. After the nail pushing plate 41 is no longer clasped by the engage button 521, by the recovering resilience of the whirled spring 43, it will automatically move upward to let its push member 411 resist against the bottom side of the rowed nail 70, letting the rowed nail 70 moved forward in sequence to a certain position in the nail striking guide base 11.

Evidently, the cover body of the nail box in this invention can easily be opened for loading a rowed nail directly into the nail guide groove of the bottom base only by moving downward the nail pushing device, able to load a rowed nail into the nail box quickly and precisely. Besides, after the rowed nail is loaded in the nail box and the cover body is closed on the bottom base, the nail-pushing device can automatically push forward the rowed nail for feeding in sequence, easy and convenient in handling.

While the preferred embodiment of the invention has been described above, it will be recognized and understood that various modifications may be made therein and the appended claims are intended to cover all such modifications that may fall within the spirit and scope of the invention.

I claim:

1. A nail box device for a nailing gun comprising:

a nailing gun provided with a nail striking guide base at the front end, and a rowed nail pushed into said nail striking guide base for use;

a nail box secured under said nail striking guide base, said nail box consisting of a bottom base and a cover body pivotally combined together, said bottom base formed with a fitting tube at one side, said fitting tube formed axially with a shaft hole, ea slide groove bored in one side of said shaft hole and communicating with the inner side of said nail box, a fitting opening formed near an intermediate location of said fitting tube, said bottom base formed with a pivotal tube at the other side, said pivotal tube formed axially with a pivotal hole, said pivotal tube having preset pivotal notches formed respectively at an upper and a lower portion, two parallel lengthwise slide rails provided at preset positions between said fitting tube and said pivotal tube, a round hole bored at a rear end between said two slide rails, said cover body formed with pivotal combining members at one side, said pivotal combining members respectively matching with said pivotal notches of said bottom base, each said pivotal combining member formed axially with a pivotal hole, a round pivot inserted through said pivotal hole of said pivotal tube and through said pivotal hole of said pivotal combining member, said round pivot pivotally combining said cover body together with said bottom base to enable said cover body to be opened and closed on said bottom base, said cover body provided with a fitting block on the other side, said fitting block formed axially with a locking hole, said fitting block fitted in said fitting opening of said bottom base, said cover body fixed with a projecting button facing said round hole of said bottom base;

a bolting device composed of a bolting rod and a spring, said bolt rod formed axially with a position limiting slide groove, said bolting rod fitted in said shaft hole of said rear section of said fitting tube of said bottom base, a position limiting bolt inserted laterally through a preset position of said lower fitting tube and said position limiting slide groove, said position limiting bolt positioning said bolting rod in said shaft hole, said bolting rod able to slide limitedly in said shaft hole, said bolting rod having its upper portion formed with a locking bolt having a comparatively small diameter, said locking bolt moving together with said bolting rod in said shaft hole, said locking bolt able to extend into said locking hole of said fitting block when said fitting block is fitted in said fitting opening of said bottom base, said bolting rod having an actuated member protruding outward from one side, said actuated member positioned in said slide groove at one side of said shaft hole of said bottom base, said spring having its upper end pushing against the lower side of said bolting rod and its lower end resisting against a bottom cover, said bottom cover secured on the bottom side of the handle of said nailing gun, said spring able to push said bolting rod upward;

a nail pushing device composed of a nail pushing plate and a pull plate, said nail pushing plate having its front end formed with a push member for pushing and feeding a rowed nail, said nail pushing plate having its rear end bored with an engage slot, an actuating member positioned beside said push member to act relatively with said actuated member of said bolt rod, two slide members respectively disposed near the opposite sides of side engage slot, said two slide members slidably positioned between said two slide rails of said bottom base and extending out of said bottom base, said pull plate provided inside with a pull member, said pull plate having opposite sides respectively formed with a fixing member, said two fixing members correspondingly combined with said two slide members of said nail pushing device for moving together, a whirled spring pivotally fitted between said two fixing members, an elastic plate of said whirled spring having one end fixed between said nail striking guide base and said bottom base, said elastic plate of said whirled spring having the other end wound around a shaft, said shaft pivotally disposed between said two fixing members; and a blocking device composed of a fixing base, an engage member and a spring, said fixing base secured on the outer side of said round hole of said bottom base, said fixing base formed inside with an accommodating slot aligned concentrically with said round hole of said bottom base, said engage member fitted in said round hole and having its lower rod extending out of said accommodating slot and fixed by a clasp, said engage member having its upper end formed with an engage button to be clasped in said engage slot of said nail pushing plate, said spring received in said accommodating slot and having opposite ends respectively resisting against said accommodating slot and the bottom side of said engage button, said spring pushing said engage button to move upward.

2. The nail box device for a nailing gun as claimed in claim 1, wherein said nail striking guide base is provided with a combining rod extending downward from the bottom to be fitted in said shaft hole of said upper fitting tube of said bottom base for combining said nail striking guide base and said bottom base together.

3. The nail box device for a nailing gun as claimed in claim 1, wherein a plurality of parallel and symmetrical nail guide grooves are axially formed at the corresponding inner sides of said bottom base and said cover body for receiving rowed nails of different specifications.

4. The nail box device for a nailing gun as claimed in claim 1, wherein said bottom cover is fixedly combined on the bottom of said handle of said nailing gun and provided with two clamping bars for clamping firmly the opposite sides of said fitting tube of said nail box.

5. The nail box device for a nailing gun as claimed in claim 1, wherein said projecting button of said cover body is a bolt of a preset length, screwed out of said cover body and extending to a preset height in the interior of the cover body.

* * * * *